US006533686B2

(12) United States Patent
LeMire

(10) Patent No.: US 6,533,686 B2
(45) Date of Patent: Mar. 18, 2003

(54) LACROSSE STICK LACE SYSTEM

(75) Inventor: Laura LeMire, Catonsville, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 09/816,316

(22) Filed: Mar. 26, 2001

(65) Prior Publication Data

US 2002/0107094 A1 Aug. 8, 2002

Related U.S. Application Data

(60) Provisional application No. 60/192,422, filed on Mar. 27, 2000.

(51) Int. Cl.[7] ..... A63B 59/02; A63B 65/12

(52) U.S. Cl. ..... 473/513

(58) Field of Search ..... 473/513, 568, 473/429, 415, 422, 423, 424, 425, 203; 138/100; 156/83

(56) References Cited

U.S. PATENT DOCUMENTS 2,142,527 A * 1/1939 Pool ..... 473/513
3,507,495 A 4/1970 Tucker et al.
5,299,802 A * 4/1994 Bouchet-Lassale ..... 473/206
5,566,947 A * 10/1996 Tucker et al. ..... 473/513
5,967,912 A * 10/1999 Hexemer et al. ..... 473/513

OTHER PUBLICATIONS

US Lacrosse Rules 2000, pp. 4–9, 2000 US Lacrosse Women's Lacrosse Rule Book.
Sparty's Lacrosse Page/Lacrosse FAQ, sparty@upside.net, http://upside.net/sparty/lax.

* cited by examiner

*Primary Examiner*—Paul T. Sewell
*Assistant Examiner*—M. Chambers
(74) *Attorney, Agent, or Firm*—Shaw Pittman LLP

(57) ABSTRACT

A lace system for a lacrosse stick that restrains thongs from sliding, maintains desired thong tension, enables convenient adjustment of thong length (in the pocket) and thong tension, provides a pocket that enhances ball control, and allows players to cut excess thong lengths to minimize their flapping around during play. The lace system includes specially shaped, sized, and positioned thong holes in the stop member of a lacrosse head, and a lace lock attached to the lacrosse stick below the thong holes. The thong holes in the stop member are not lined up in a straight line, are non-circular in shape, and are slightly smaller than the size of the thongs. The lace lock includes channeling holes and/or channels that align and compress the thongs, ridges that grip the thongs, a compression strap that locks the thongs tightly against the ridges, and a means for attaching the lace lock to the lacrosse stick.

22 Claims, 19 Drawing Sheets

LACROSSE STICK LACE SYSTEM

This application claims the benefit of the filing date of U.S. Provisional Application No. 60/192,422, filed Mar. 27, 2000, which is hereby incorporated by reference in its entirety.

BACKGROUND

1. Field of the Invention

The present invention relates generally to lacrosse sticks, and more particularly, to a lacrosse stick having stop member thong holes and a lace lock adapted to lock thongs in place under a desired tension and in a favorable alignment, and to a method for locking the thongs in place.

2. Background of the Invention

One of the most vital components of a lacrosse stick is the lace system that forms the pocket. This pocket contributes to the overall performance of a lacrosse stick, especially with regard to ball handling. A lacrosse player relies on the feel and accuracy of the lace system for such skills as catching the ball, carrying and protecting the ball, cradling the ball, and throwing the ball. Further, a lacrosse player needs a lace system to dependably retain its characteristics during play, so that the lacrosse stick delivers superior, consistent performance even when exposed to the typical abuses of competition, such as harsh impacts, flexing, and inclement weather.

FIG. 1 illustrates a front view of a conventional molded head lacrosse stick. As shown, lacrosse stick 100 comprises a handle 102 shown in dotted lines, and a synthetic head 104. As used herein, "stick" refers to a complete sports apparatus, of which the head and the handle are components. Head 104 comprises a generally V-shaped frame having a core area (also referred to as a throat area) 106, sidewalls 108 and 110, a scoop (or transverse wall) 112 joining the sidewalls at the end opposed to core area 106, and a stop member 114 joining sidewalls 108 and 110 at the end nearest core area 106. As shown, handle 102 fits into and through core area 106, and abuts stop member 114. Typically, a screw or other fastener placed through opening 107 secures handle 102 to head 104.

For traditionally-strung pockets, four or five thongs (not shown) made of leather or synthetic material extend from upper thong holes 116 in scoop 112 to stop member thong holes 118 in stop member 114. FIG. 1 shows four pairs of thong holes that accept four thongs. To complete the pocket web, the thongs have nylon strings threaded around the thongs and string laced through string holes 120 in sidewalls 108 and 110, forming eight to twelve diamonds (crosslacing). Finally, one or more throwing or shooting strings extend transversely between the upper portions of sidewalls 108 and 110, attaching to throwing string hole 124 and a string laced through string hole 122. The typical features of a lacrosse stick are all shown generally in Tucker et al., U.S. Pat. No. 3,507,495 and Tucker et al., U.S. Pat. No. 5,566,947, which are both incorporated by reference herein in their entireties.

Traditionally strung lacrosse heads use stop member thong holes 118 arranged substantially in a straight line through stop member 114, in generally the same horizontal plane as the bottom of head 104. The thongs extend from upper thong holes 116 of scoop 112, where they are typically looped and fed back through themselves, to stop member thong holes 118 in stop member 114. Because scoop 112 and stop member thong holes 118 are in the same plane, the thongs, when taut (e.g., for a women's lacrosse stick), and the entire pocket are in one plane, remaining essentially flat.

When such a pocket catches a ball and brings the ball to rest against the stop, the round shape of the ball against the flat configuration of the pocket results in minimal surface contact between the pocket and the ball. This minimal contact reduces the lacrosse head's ability to hold and protect a ball as it lies against stop member 114. Further, the small contact area between the pocket and the ball compromises a player's accuracy during a throwing motion, when the ball travels up the pocket to the throwing strings and out of the pocket. These deficiencies in conventional lace systems noticeably detract from a player's performance and enjoyment of the game.

Although most conventional lacrosse heads align stop member thong holes in a straight line, some stop member designs feature stop member thong holes with center holes that are higher than the holes closer to the sidewalls.

In addition to the undesirable effects of conventional stop member thong hole configurations, a related problem that further frustrates player's performance is the gradual loosening of the lace system of a pocket during play. Under United States Women's Lacrosse Rules, the combined height of the lacrosse head sidewall and pocket must not exceed 2½ inches, the diameter of a regulation lacrosse ball. Because a shallower pocket makes ball control more difficult, most players attempt to keep the combined height as close to 2½ inches as possible, without exceeding the allowable height. However, because thongs are typically made of a deformable material, most often leather, the thongs and entire pocket stretch under stress from impacts with and cradling of the ball.

Aware of the desire to maximize pocket depth and the effects of stretching, lacrosse umpires routinely conduct equipment checks before and during play, on their own initiative or at the request of an opponent. According to the rules, if a pocket is found not to meet specification during play, the umpire removes the stick from the game and places it at the scorer's table for the remainder of the half. The stick, once corrected, cannot return to play until the umpire re-inspects the stick prior to the start of the second half or overtime period. For a player with a special preference for a certain lacrosse stick, this penalty can be detrimental to the player's performance. In addition, the penalty of removing sticks burdens individual players and teams with having to stock additional spare sticks. Additionally, in the event that a goal is scored with a stick subsequently determined to be illegal, that goal is nullified.

The traditional methods for complying with the pocket rules while maximizing pocket depth have been quite basic. On a typical stick, the thongs extend 10–12 inches beyond stop member 114 to enable players to pull them to adjust the pocket tension. Players fasten the thongs by threading them through stop member thong holes 118, tying them in knots around the back of stop member 114, and then possibly tying all of the thongs together. To keep the thongs from flapping about during play, most players tape the exposed ends of the thongs or tape the entire length of the thongs beyond the throat to the stick handle. Such jury-rigged arrangements make quick adjustment of the thongs virtually impossible. Therefore, sticks found not to meet specification cannot be readily fixed and must be removed from the game and attended to on the sidelines.

Although United States Men's Lacrosse Rules place less emphasis on a straight pocket, management of the lace system during play is still a concern. Men's rules permit a pocket depth of up to 2½ inches, below a sidewall that is up to 2 inches high. According to the traditional test, when looking horizontally at the sidewall of the men's lacrosse stick with a regulation ball inside the pocket, the sidewall must obstruct the view of at least a portion of the ball. (The total height of the sidewall and pocket must not exceed 4½ inches.) Thus, although the tension of the thongs is less critical in the men's game, players must ensure that the thongs and pockets do not sag excessively. In addition, players often desire that the excess lengths of the thongs extending from the lacrosse head stop be contained, to avoid their whipping around the head during play.

In addition to the traditional methods of tying and taping, U.S. Pat. No. 5,967,912 to Hexemer et al. is directed toward a device for locking the lacing material of a lacrosse head. This patent discloses a lace lock device that is formed integral to a lacrosse head and includes set screws, cams, and/or clamps for holding thongs in place under a desired tension. Although the clamp embodiment of the lace lock device is intended to enable a certain degree of thong adjustment while still maintaining thong tension, in actual use, the design tends to release and allow the slipping of the thongs, thereby defeating its primary purpose. The other embodiments that better secure the thongs, such as the set screws, provide considerably less adjustment capabilities. In addition to the thong tension and adjustment deficiencies, the disclosed device also cooperates with the conventional stop member thong holes that are arranged in a straight line, creating the unfavorable flat pocket. Further, the patent teaches a device that has at least one component integral to the lacrosse head, making the device incompatible with an existing lacrosse stick. Unfortunately, for the lacrosse player desiring an inexpensive retrofit, the integral design requires the costly purchase of a brand new stick.

SUMMARY OF THE INVENTION

The present invention is a lace system for a lacrosse stick that restrains thongs from sliding, maintains desired thong tension, enables convenient adjustment of thong length (in the pocket) and thong tension, provides a pocket that enhances ball control, and allows players to cut excess thong lengths to minimize their flapping around during play. According to a representative embodiment of the present invention, the lace system includes specially shaped, sized, and positioned thong holes in the stop member of a lacrosse head, and a lace lock attached to the lacrosse stick below the thong holes.

In a preferred embodiment of the present invention, the thong holes in the stop member are not lined up in a straight line, are non-circular in shape, and are slightly smaller than the thongs. For placement, the thong holes are preferably in different horizontal planes. More preferably, the thong holes toward the center of the stop member are lower than the thong holes closer to the sidewalls. (With reference to the stop member thong holes, the term "lower" as used herein means closer to the bottom of the lacrosse stick head where the pocket is situated. Likewise, "higher" means closer to the face or top of the lacrosse stick head.) Thus, in the case of a four-thong pocket, the two inner thong holes are lower than the two outer thong holes. This unique configuration gives the pocket a more rounded shape and creates a center channel running between the two outer thong holes.

Thus, instead of the flat pockets of the prior art, the present invention provides a rounded pocket that more closely conforms to the shape of the lacrosse ball, increases the surface contact between the ball and pocket, and improves the overall ball control of the stick. The center channel between the thong holes brings the ball naturally to rest in the center of the deeper pocket for easier catching. In addition, for more accurate passing and shooting, the center channel provides a controlled path through which the ball travels from the stop member toward the scoop.

The thong holes in the stop member are also preferably non-circular to properly align and orient the thongs before they enter the lace lock. The non-circular shape is preferably a rectangle, or a rounded rectangle with long horizontal sides that are flat and shorter vertical sides that are rounded. This shape resists the twisting or rotating of the thongs and keeps the wide faces of the thongs roughly at a tangent to the ball's surface and nearly parallel to the face of the lacrosse head. Alternatively, the shape of the thong holes may be an oval.

Also, preferably each thong hole is slightly smaller than the size of a cross-section of a thong so that the thong must be compressed to pass through the thong hole. In this manner, the thong hole does not allow the thong to easily slide and thereby contributes to the overall securing of the thongs.

In a preferred embodiment, the lace lock includes two sets of channeling holes that align and compress the thongs, ridges that grip the thongs, a compression strap that locks the thongs tightly against the ridges, and a means for attaching the lace lock to the lacrosse stick. The two sets of channeling holes, on the incoming and exiting sides of the lace lock, position the thongs over the ridges which are located on a curved plane to increase contact between the thongs and the ridges. Optionally, instead of the incoming set of channeling holes, the lace lock can include wedge-shaped thong channels that control the orientation of the thongs as they exit the stop member and enter the lace lock.

In a preferred embodiment of the present invention, the lace lock removably attaches to an existing lacrosse stick handle just below the stop. Therefore, although a player may not be able to retrofit an existing lacrosse stick with the stop member thong holes of the present invention, the player could attach the lace lock to an existing stick to derive the benefits of secured and easily adjustable thong tension. The means for attaching the lace lock can be any suitable fastener, e.g., a screw through the lace lock and into the handle, a hook and loop fastener attached to the sides of the lace lock and fastened around the stick handle, or an interference fit provided by matching configurations of the lace lock and handle or lacrosse head.

For the two-set channeling hole configuration, the lace lock receives the thongs from the thong holes of the stop member through its incoming channeling holes. The incoming channeling holes are adapted to keep the thongs horizontal and spaced apart from each other, so that each thong can contact the ridges evenly across its entire face. This evenly-spaced contact enables the ridges to better grip the thongs, reduce sliding of the thongs, and better maintain the desired tension of the pocket. Likewise, the exiting channeling holes are also adapted to keep the thongs horizontal and spaced apart from each other as they pass out of the lace lock.

For the wedge-shaped thong channel configuration, the lace lock includes only exiting channeling holes. In place of incoming channeling holes, the wedge-shaped thong channel is adapted to change the orientation of a thong from horizontal as it exits the thong hole to vertical as it passes through the wedge-shaped thong channel, and (working in combination with the exiting holes) back to horizontal as it exits the wedge-shaped thong channel and enters the lace lock. By changing the orientation of the thongs, the wedge-shaped thong channels further secure the thongs. The exiting channeling holes are adapted to keep the thongs spaced apart and to return the thongs to a horizontal orientation across the lace lock ridges.

With either the two-set channeling hole configuration or the wedge-shaped channel configuration, once the thongs are laced through the lace lock, a compression strap of a width substantially equal to the width of the ridged area is wrapped over the series of ridges of the lace lock and around the lacrosse stick. The ridges are preferably a textured or resilient surface that grips the thongs, e.g., sharp triangles, ridges, nubs, or spikes. The compression strap is preferably a hook and loop fastener with a fastener for looping the compression strap back over itself, drawing it tight around the stick, and joining the hooks and loops together. The compression strap forces the thongs against the ridges and locks the thongs in place. Optionally, the compression strap can be threaded through a compression plate and drawn tightly around the stick and over the ridged surface so that ridges on the compression plate line up between the ridges on the lace lock, thereby locking the thongs between the opposing ridges. In addition to securing the thongs, the compression strap can also be used to fasten the lace lock to a lacrosse stick, or alternatively, a separate hook and loop fastener could be used to fasten the lace lock to the lacrosse stick.

Together, the above components enable quick tension adjustment of the thongs, which can avoid the removal of a lacrosse stick having an illegal pocket by allowing a player to quickly shorten and tighten her pocket during a break in play if the player suspects that the pocket may have become illegal. The present invention enables a player to quickly release the compression strap, pull the thongs to the desired tension to create a legal pocket, and tighten the compression strap to keep the thongs securely locked against the ridges of the lace lock and held under the desired tension. Further, the specially sized and shaped thong holes, the wedge-shaped thong channels, and the lace lock channel holes all cooperate to further resist the movement of the thongs and to orient the thongs for optimal locking and ball roll. In addition, the specially located thong holes enhance ball control by providing a pocket that cups the ball, naturally centers the ball, and directs the ball over and out of the pocket along a straight path for more accurate throws.

In addition to quick tension adjustment, the present invention restrains the thongs from sliding loose once the desired thong tension is established between the scoop and the lace lock. And, as a further benefit, the present invention allows a player to cut the excess lengths of the thongs to prevent their flapping around during play, thereby minimizing the need for tape or other makeshift means for managing the excess thong lengths.

Accordingly, an object of the invention is to provide an apparatus that secures lacrosse head thongs and resists loosening of the thongs in the lacrosse head pocket.

Another object of the present invention is to provide an apparatus that accurately and conveniently adjusts and secures the length and tension of lacrosse head thongs.

Another object of the invention is to provide an apparatus that secures lacrosse head thongs in a position that increases the throwing accuracy of a lacrosse stick.

Another object of the present invention is to provide an apparatus that secures lacrosse head thongs on an existing lacrosse stick without requiring modification of the stick.

Another object of the present invention is to maintain thongs under a desired tension and to enable a player to manage excess thong lengths.

These and other objects and advantages of the present invention are described in greater detail in the detailed description of the invention, and the appended drawings. Additional features and advantages of the invention will be set forth in the description that follows, will be apparent from the description, or may be learned by practicing the invention.

DETAILED DESCRIPTION OF THE INVENTION

Figure 1:
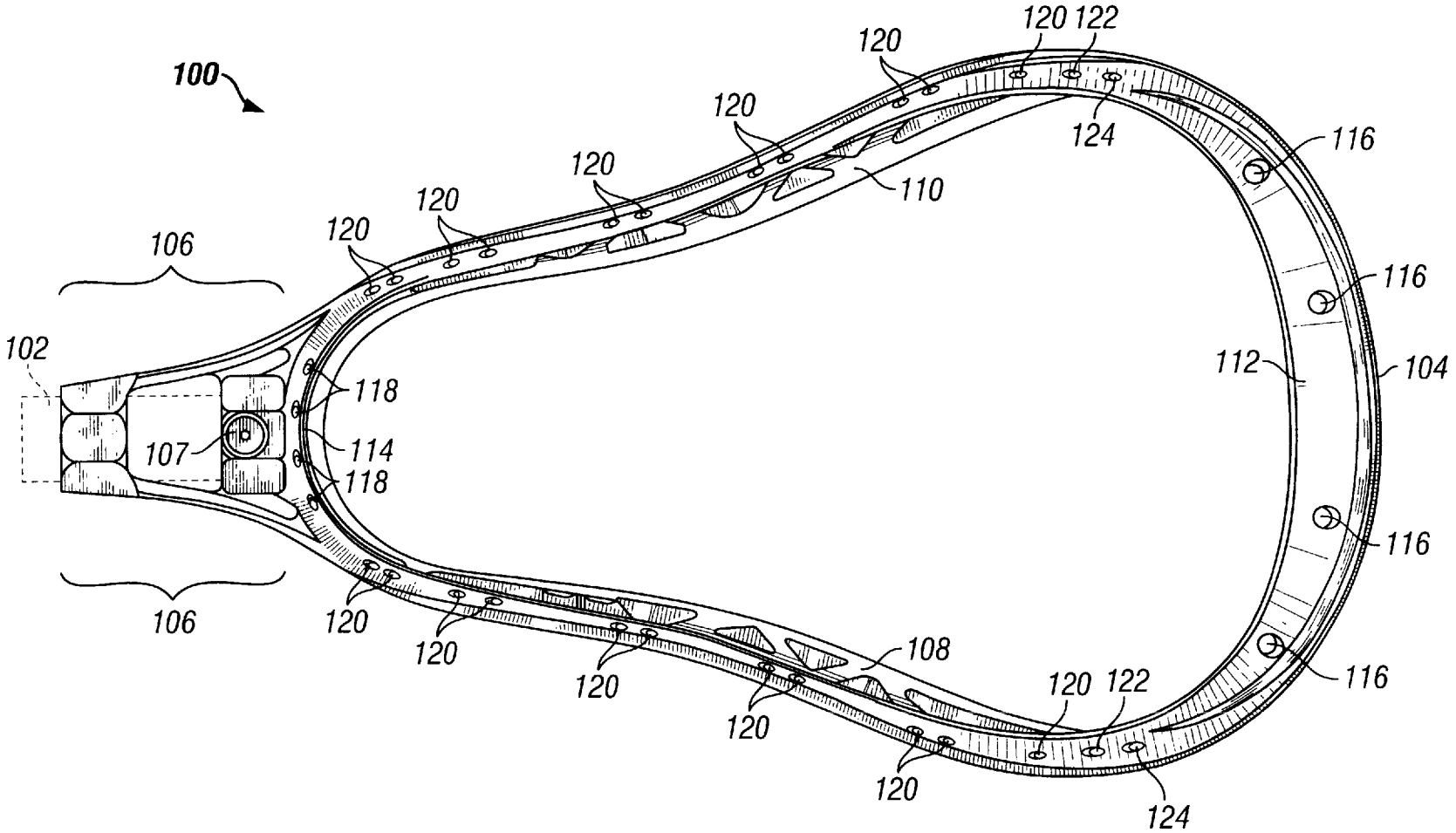
FIG. 1 (Prior Art)
FIG. 1 is a schematic diagram of a prior art lacrosse stick.
Figure 2A:
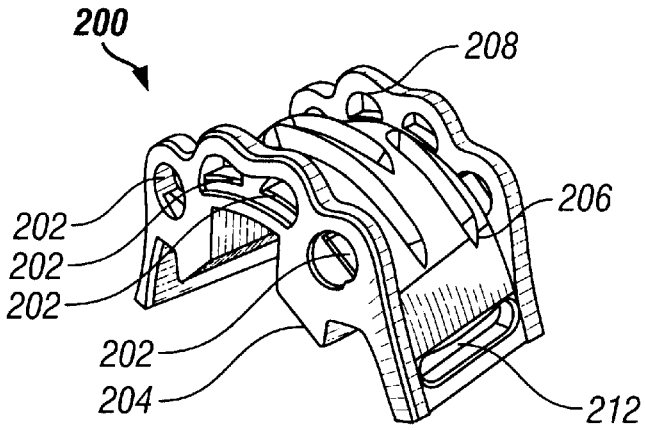
FIG. 2A is an isometric diagram of a preferred embodiment of the lace lock of the present invention, having two sets of channeling holes.
Figure 2B:
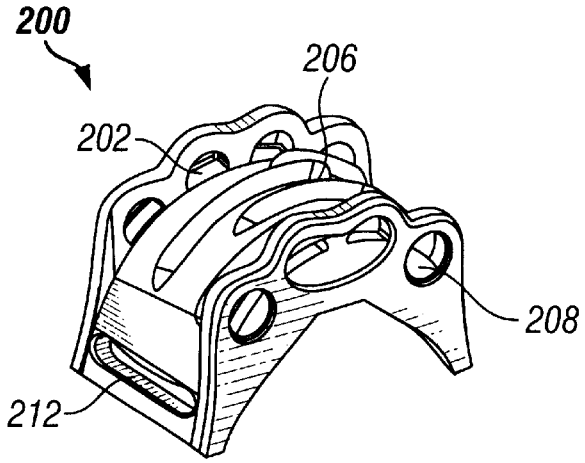
FIG. 2B is an isometric diagram of the lace lock shown in FIG. 2A, from a reverse perspective.
Figure 2C:
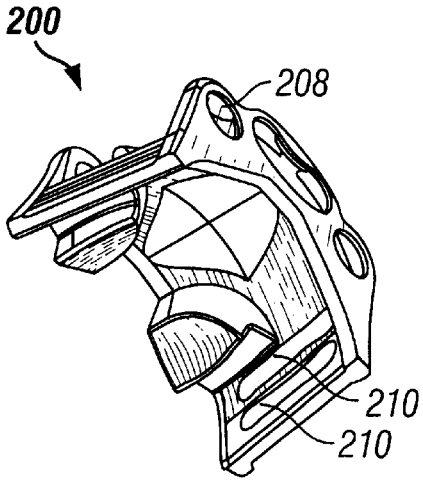
FIG. 2C is an isometric diagram of the lace lock shown in FIG. 2A, from a bottom perspective.
Figure 2D:
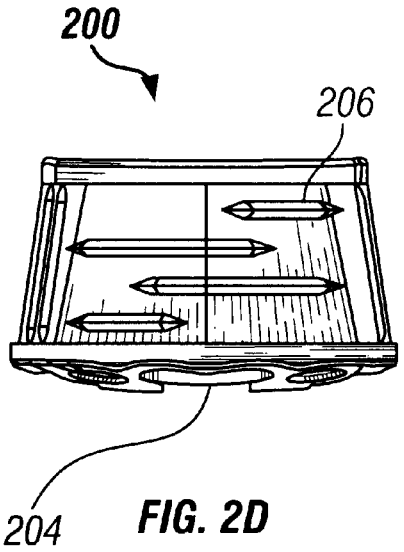
FIG. 2D is a schematic diagram of a top view of the lace lock shown in FIG. 2A.
Figure 2E:
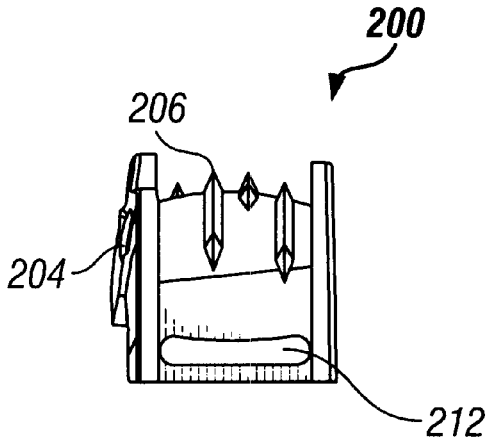
FIG. 2E is a schematic diagram of a side view of the lace lock shown in FIG. 2A, looking at the ridges.
Figure 2F:
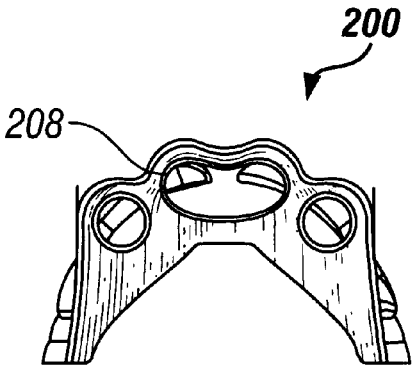
FIG. 2F is a schematic diagram of a side view of the lace lock shown in FIG. 2A, looking at the exiting channel holes.
Figure 2G:
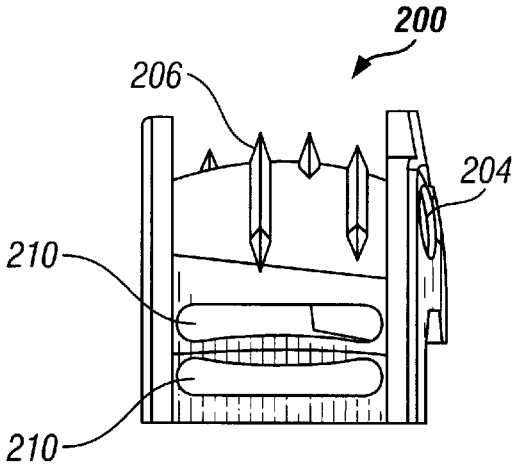
FIG. 2G is a schematic diagram of a side view of the lace lock shown in FIG. 2A, looking at the ridges.
Figure 2H:
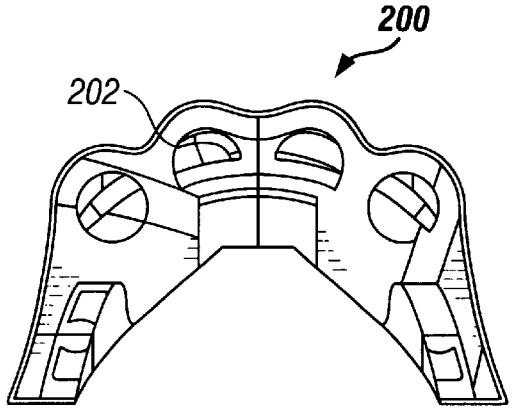
FIG. 2H is a schematic diagram of a side view of the lace lock shown in FIG. 2A, looking at the incoming channel holes.
Figure 2I:
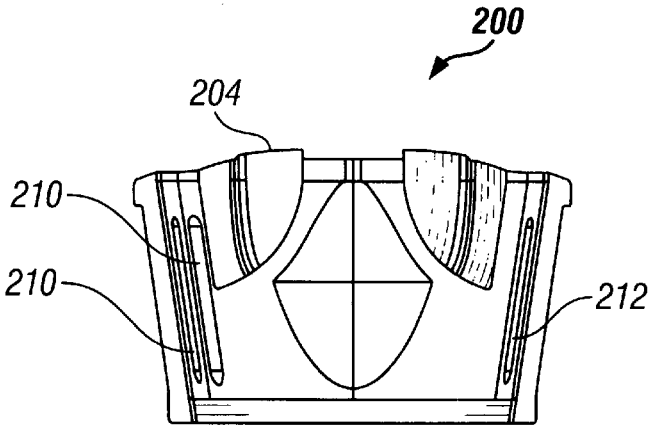
FIG. 2I is a schematic diagram of a bottom view of the lace lock shown in FIG. 2A.
Figure 3A:
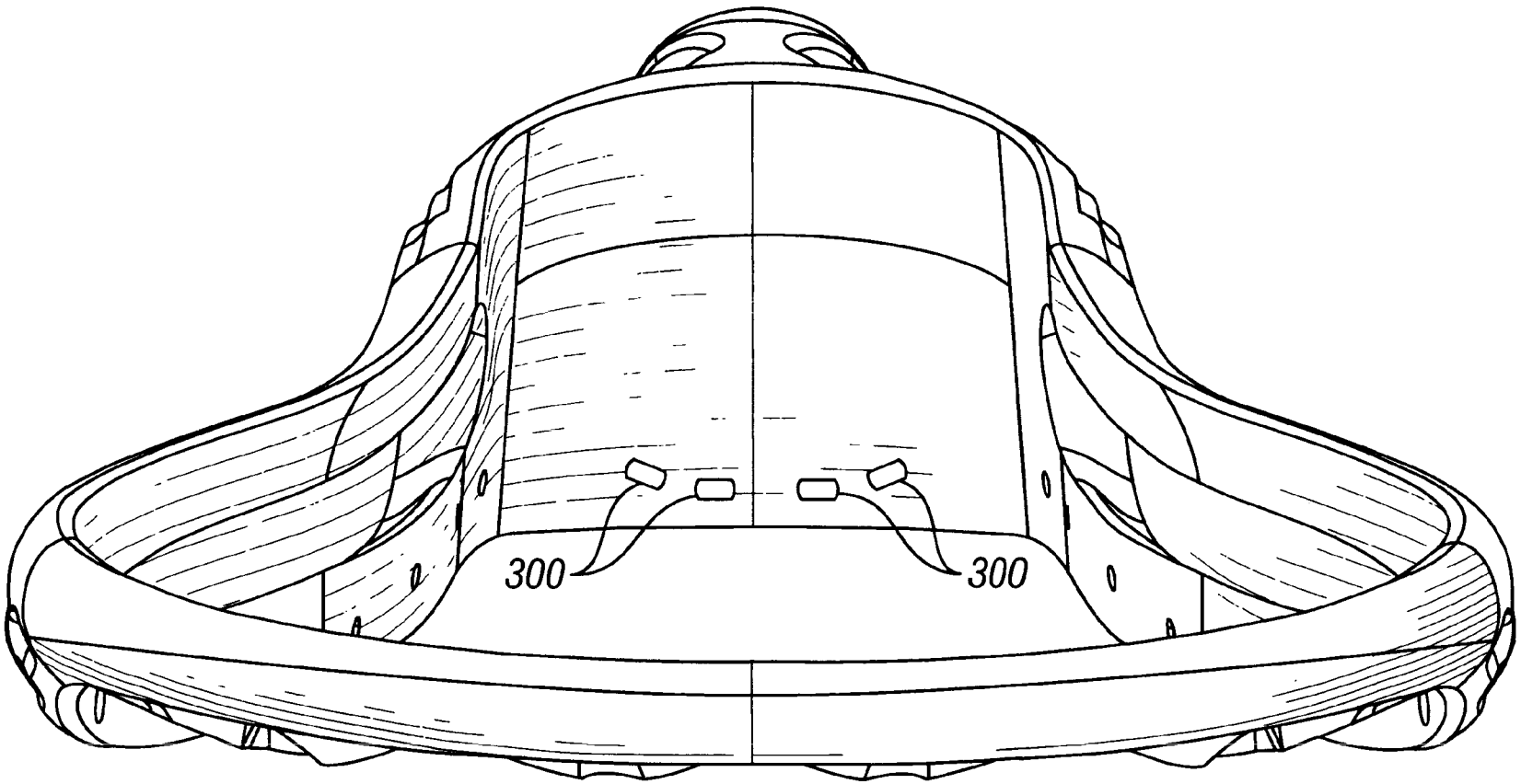
FIGS. 3A–3C are schematic diagrams illustrating a preferred embodiment of the lacrosse head stop member of the present invention.
Figure 3B:
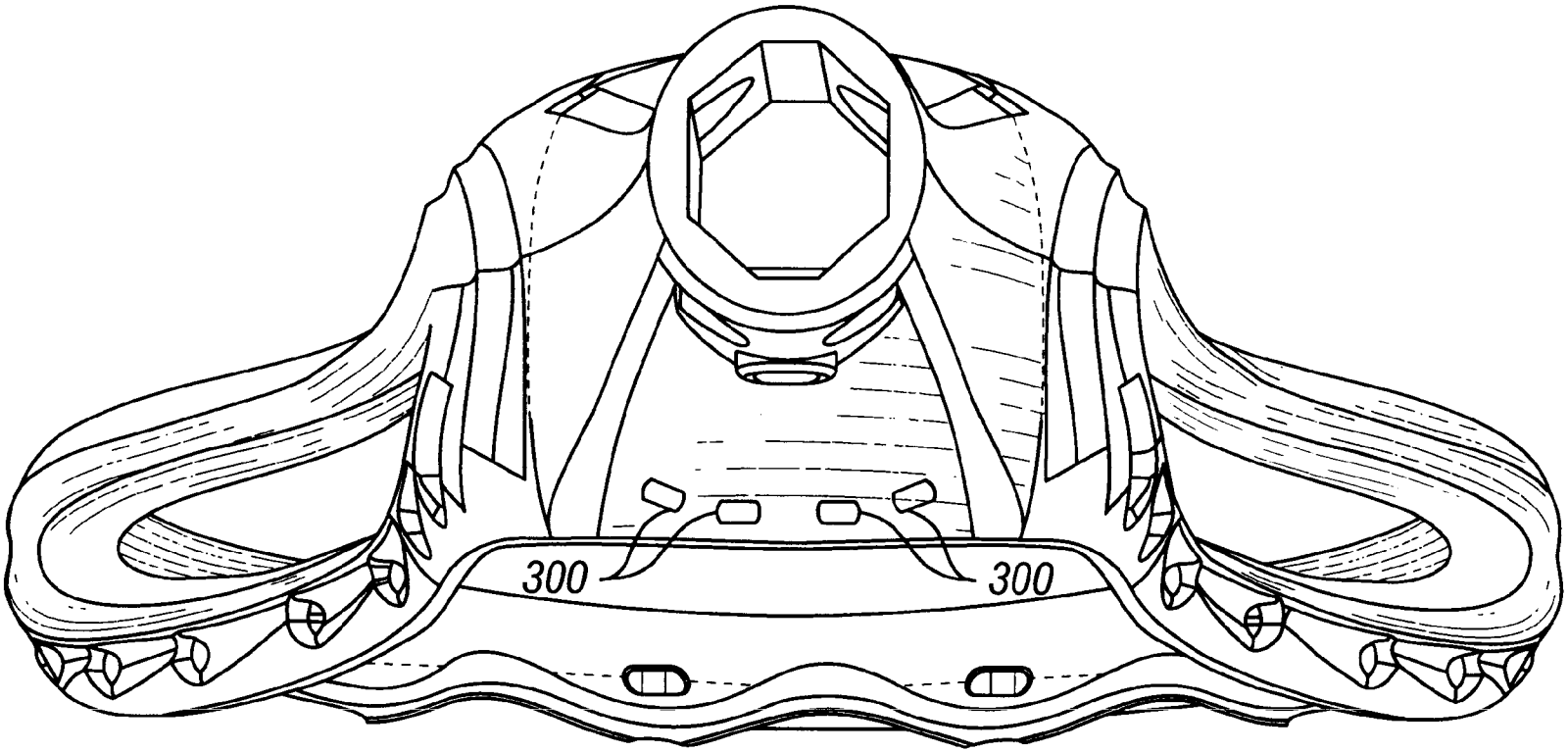
Figure 3C:
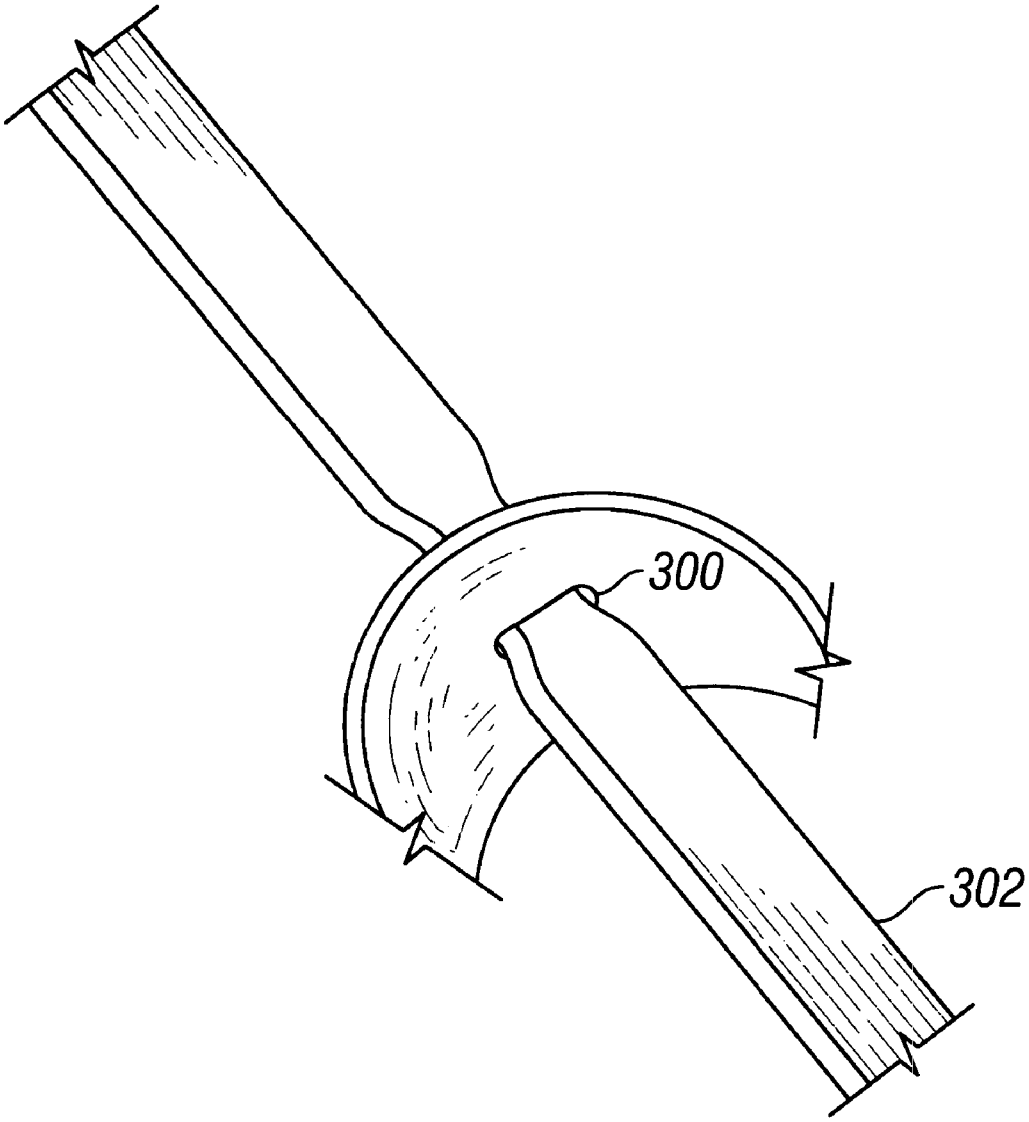

According to a representative embodiment, the present invention is a lace system for a lacrosse stick that provides quickly adjustable and positively locked pocket tension and greater ball control, using specially shaped, sized, and positioned thong holes in the stop member of a lacrosse stick, and a lace lock removably attached to the stick below the thong holes. FIGS. 2A–2I illustrate a preferred embodiment of lace lock 200 with two sets of channeling holes. FIGS. 3A–C illustrate thong holes 300 in the stop member of a lacrosse stick. FIGS. 4A–4L illustrate an alternate preferred embodiment of lace lock 200, having incoming thong channels and exiting channeling holes.

FIGS. 2A–2I show a preferred embodiment of the present invention, illustrating a removably attachable lace lock 200 having incoming channeling holes 202 that receive thongs from thong holes 300 (shown in FIGS. 3A and 3B). Installed on a lacrosse stick, side 204 of lace lock 200 faces the stop member of the lacrosse stick, which has thong holes 300.

The stop member of the lacrosse head, as shown in FIGS. 3A and 3B, contains thong holes 300 preferably arranged in a non-linear configuration. More preferably, thong holes 300 are located such that the inner thong holes are lower than the outer thong holes. For example, for a three-thong pocket, the single inner thong hole is at the lower position and the two outer thong holes are at the higher position. For a four-thong pocket, the two inner thong holes are preferably at the lower position. For a five-thong pocket, the single center thong hole and its two adjacent thong holes are at the lower position. Optionally, in the five-thong configuration, the center thong hole could be even lower than its adjacent thong holes.

As shown in FIGS. 3A and 3B, thong holes 300 are also preferably non-circular to properly align and orient the thongs before they enter the lace lock. For example, the non-circular shape could be an oval, a rectangle, or a rounded rectangle with long horizontal sides that are flat and shorter vertical sides that are rounded. Also, as shown in FIG. 3C, thong holes 300 preferably are slightly smaller than the size of a cross-section of a thong 302 so that thong 302 must be compressed to pass through a thong hole 300.

FIGS. 2A–2I illustrate from various perspectives the preferred components of lace lock 200, including incoming channeling holes 202, ridges 206, and exiting channeling holes 208. Although ridges 206 are depicted as triangular ridges, one of ordinary skill in the art would appreciate that ridges 206 could be any structure or resilient material suitable for gripping leather or synthetic thongs, such as nubs, spikes, or other textured surfaces. Preferably, incoming channeling holes 202 and exiting channeling holes 208 are adapted to keep the thongs spaced apart from each other, so that each thong evenly contacts ridges 206. This evenly spaced contact enables the ridges to better grip the thongs, reduce sliding of the thongs, and better maintain the desired tension of the pocket.

In addition, incoming channeling holes 202 and exiting channeling holes 208 are preferably shaped to orient the thongs with the wide side of each thong facing ridges 206, so that ridges 206 grip the larger surface areas of the thong faces. Also, preferably incoming channeling holes 202 and exiting channeling holes 208 are slightly smaller than the size of a cross-section of a thong (similar to thong hole 300 shown in FIG. 3C) so that the thongs must be compressed to pass through channeling holes 208, further contributing to the locking of the thongs.

In a preferred embodiment, lace lock 200 is adapted to receive a compression strap that wraps over the area of the ridges 206 and locks the thongs in place. Preferably, the compression strap is a hook and loop fastener attached to or threaded through one or more of slots 210 and 212, as shown most clearly in FIGS. 2A, 2B, 2C, 2E, 2G, and 2I.

Lace lock 200 can be fixed to a lacrosse stick using any suitable fastening means, including only the compression strap used to lock the thongs. Preferably, however, the means for attaching lace lock 200 is a component separate from the compression strap, such as a screw driven through the lace lock and into the lacrosse stick head, the handle, or both. As another example, the means for attaching lace lock 200 could be a separate hook and loop fastener attached to one or more of slots 210 and 212 and fastened around the stick head or handle. In this manner, lace lock 200 removably attaches to an existing lacrosse stick head or handle below the stop, to enable a player to retrofit an existing lacrosse stick.

As another preferred embodiment of the present invention, FIGS. 4A–4L illustrate lace lock 400 having channels 402 instead of the incoming channeling holes 202 shown in FIGS. 2A–2I. Lace lock 400 joins the stop member of a lacrosse head at side 204. As shown in FIGS. 3A–C, the stop member of the lacrosse head contains thong holes 300, preferably sized, shaped, and arranged in a non-linear configuration as described above.

FIGS. 4A, 4C, 4E, 4F, and 4G illustrate the preferred components of lace lock 400, including ridges 206 and channeling holes 208. Although ridges 206 are depicted as triangular ridges, one of ordinary skill in the art would appreciate that ridges 206 could be any structure or resilient material suitable for gripping leather or synthetic thongs, such as nubs, spikes, or other textured surfaces. Preferably, channeling holes 208 are adapted to keep the thongs spaced apart from each other, so that each thong evenly contacts ridges 206. This evenly spaced contact enables the ridges to better grip the thongs, reduce sliding of the thongs, and better maintain the desired tension of the pocket.

Figure 4B:
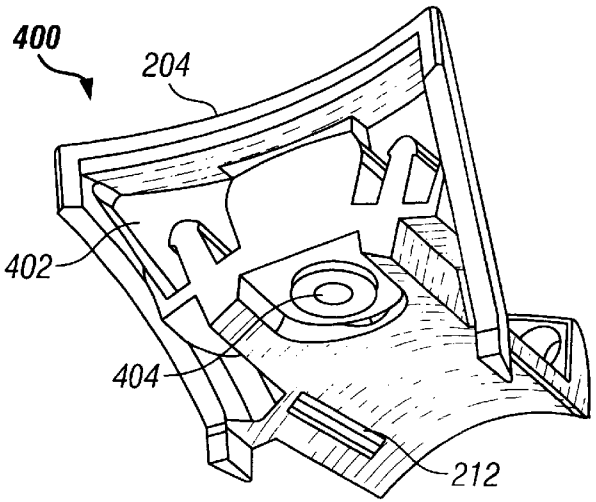
FIG. 4B is an isometric diagram of the lace lock shown in FIG. 4A, from a bottom perspective.
Figure 4C:
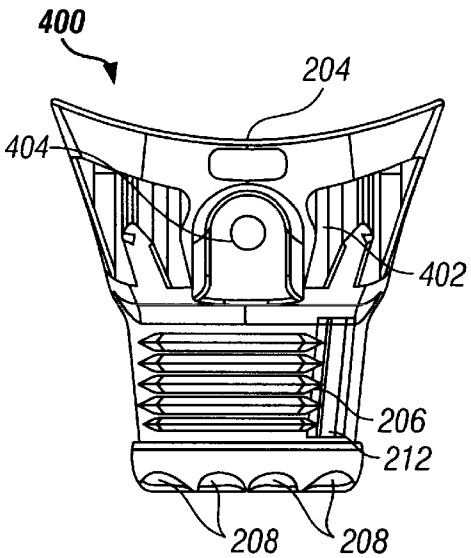
FIG. 4C is a schematic diagram of a top view of the lace lock shown in FIG. 4A.
Figure 4A:
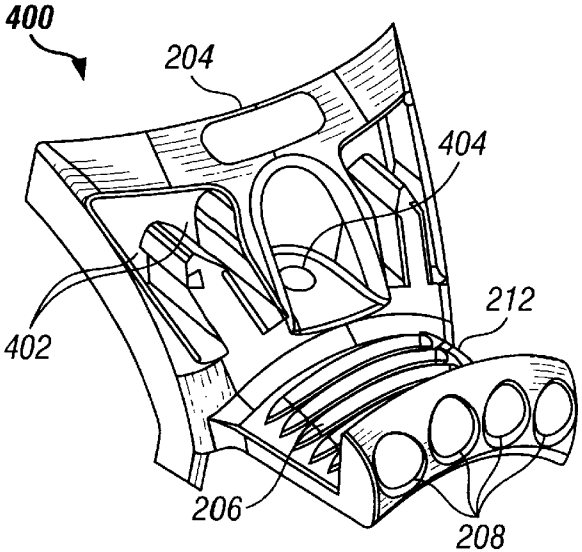
FIG. 4A is an isometric diagram of a preferred embodiment of the lace lock of the present invention, having channels and channeling holes.
Figure 4E:
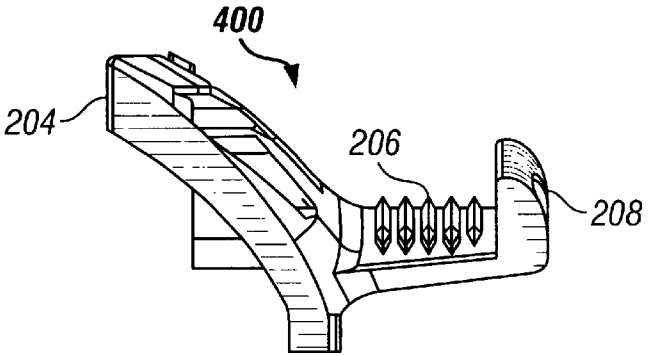
FIG. 4E is a schematic diagram of a side view of the lace lock shown in FIG. 4A, looking at the ridges.
Figure 4D:
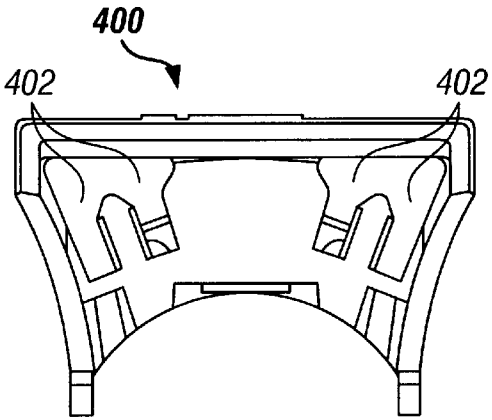
FIG. 4D is a schematic diagram of a side view of the lace lock shown in FIG. 4A, looking at the channels.
Figure 4H:
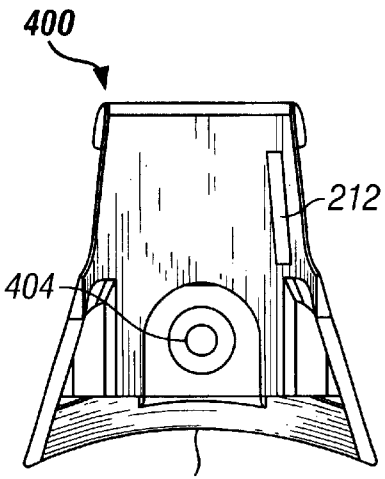
FIG. 4H is a schematic diagram of a bottom view of the lace lock shown in FIG. 4A.
Figure 4G:
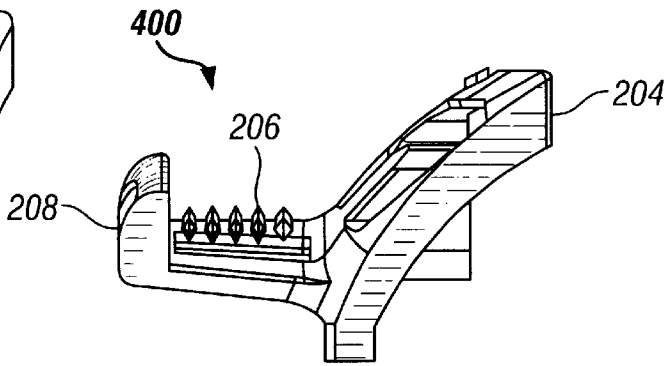
FIG. 4G is a schematic diagram of a side view of the lace lock shown in FIG. 4A, looking at the ridges.
Figure 4F:
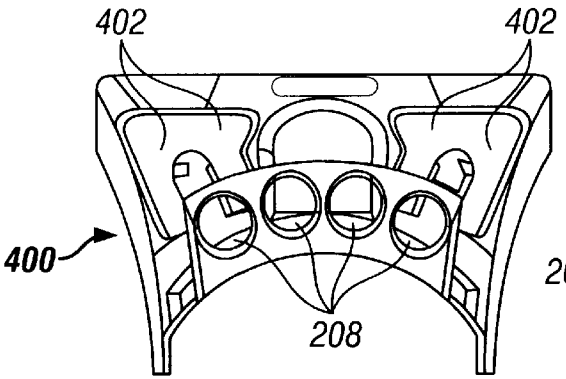
FIG. 4F is a schematic diagram of a side view of the lace lock shown in FIG. 4A, looking at the channeling holes.

Although channeling holes 208 could be substantially circular as shown in FIGS. 4A and 4F, channeling holes 208 are preferably shaped to orient the thongs with their wide sides facing ridges 206, so that ridges 206 can grip the larger surface area of the face of the thongs. For example, channeling holes 208 could be flat on the top and bottom, and round on the sides. Also, preferably channeling holes 208 are slightly smaller than the size of a cross-section of a thong (similar to thong hole 300 shown in FIG. 3C) so that the thongs must be compressed to pass through channeling holes 208, further contributing to the locking of the thongs.

In a preferred embodiment, channels 402 are adapted to control the orientation of the thongs as they pass from thong holes 300 (FIGS. 3A and 3B) to lace lock 400. Preferably, channels 402 are shaped, e.g., wedge-shaped, to change the orientation of the thongs from horizontal as the thongs exit thong holes 300 to vertical (90-degree rotation) as the thongs pass through channels 402. By changing the orientation of the thongs, channels 402 further secure the thongs and prevent sliding. Once the thongs exit channels 402, the thongs rotate 90 degrees back to horizontal and enter the interior portion of lace lock 400. Channeling holes 208 turn the thongs the 90 degrees back to horizontal so that the thongs traverse the interior portion of lace lock 400 in a horizontal orientation better suited for contacting ridges 206 and securing the thongs.

In a preferred embodiment, lace lock 400 is adapted to receive a compression strap that wraps over the area of the ridges 206 and locks the thongs in place. Preferably, the compression strap is a hook and loop fastener attached to or threaded through one or more of slots 212, as shown most clearly in FIGS. 4A, 4B, 4C, and 4H.

In the preferred embodiment of the present invention, lace lock 400 removably attaches to the lacrosse stick handle using any suitable fastener, including using only the compression strap that locks the thongs against ridges 206. Examples of other suitable fastening means are a screw driven into the stick handle (or into the head, or both the handle and head) through opening 404 as shown in FIGS. 4A, 4B, 4C, and 4H, or a hook and loop fastener separate from the compression strap attached to or threaded through one or more of slots 212.

Figure 4K:
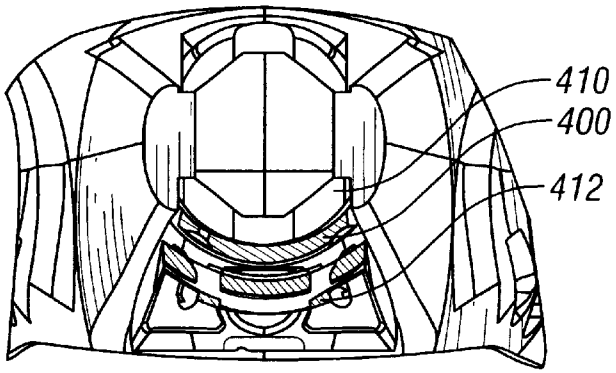
FIG. 4K is a cross-sectional view of the lacrosse head and lace lock of FIG. 4I along line B—B.
Figure 4L:
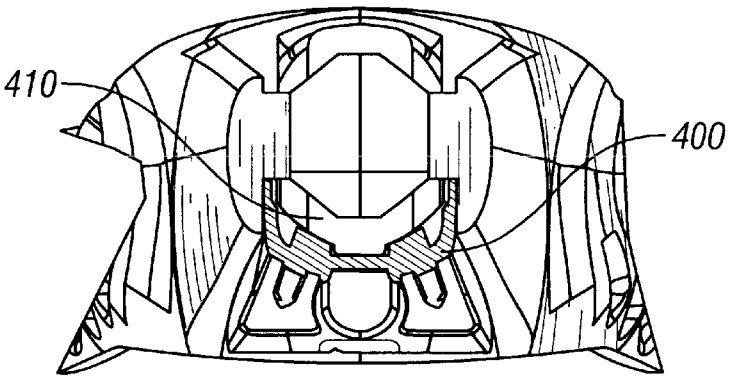
FIG. 4L is a cross-sectional view of the lacrosse head and lace lock of FIG. 4I along line C—C.
Figure 4I:
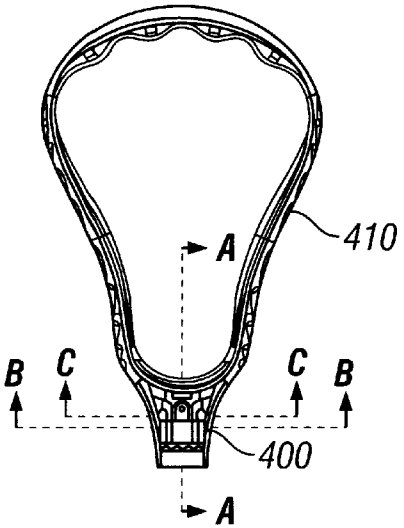
FIG. 4I is a schematic diagram of a bottom view of lacrosse head with a lace lock attached using an interference fit, according to a preferred embodiment of the present invention.
Figure 4J:
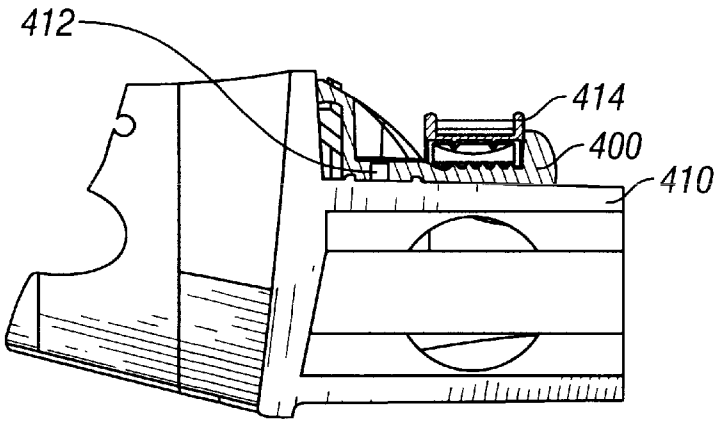
FIG. 4J is a cross-sectional view of the lacrosse head and lace lock of FIG. 4I along line A—A.
Figure 5B:
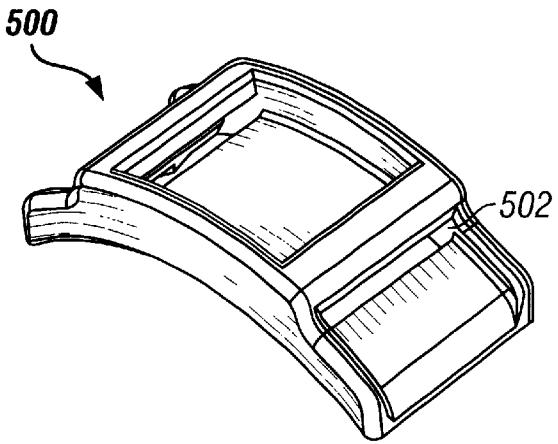
FIG. 5B is an isometric diagram of the compression plate shown in FIG. 5A, from a top perspective.
Figure 5D:
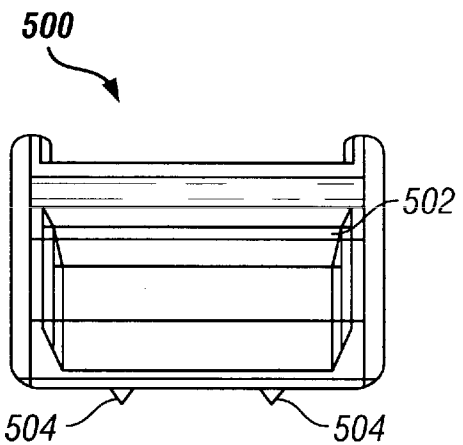
FIGS. 5D–5F are schematic diagrams of side views of the compression plate shown in FIG. 5A.
Figure 5A:
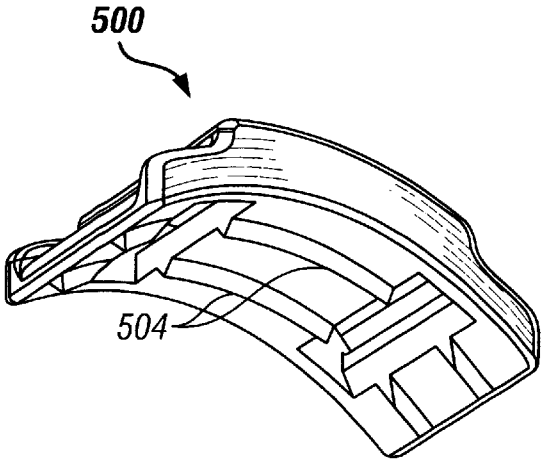
FIG. 5A is an isometric diagram of a preferred embodiment of the compression plate of the present invention from a bottom perspective.
Figure 5C:
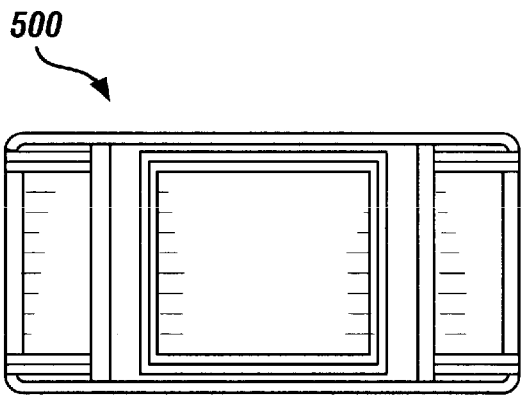
FIG. 5C is a schematic diagram of a top view of the compression plate shown in FIG. 5A.
Figure 5E:
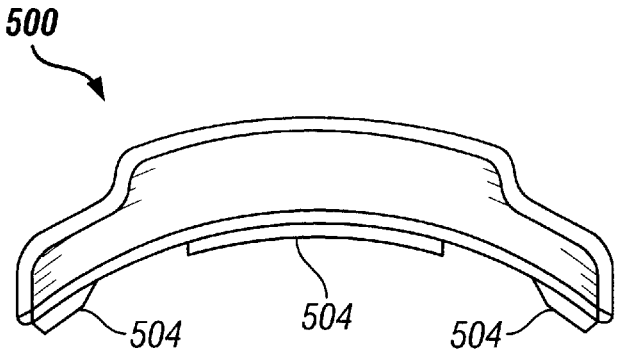
Figure 5F:
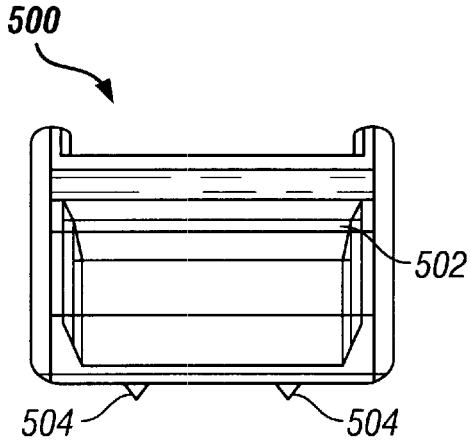
Figure 5G:
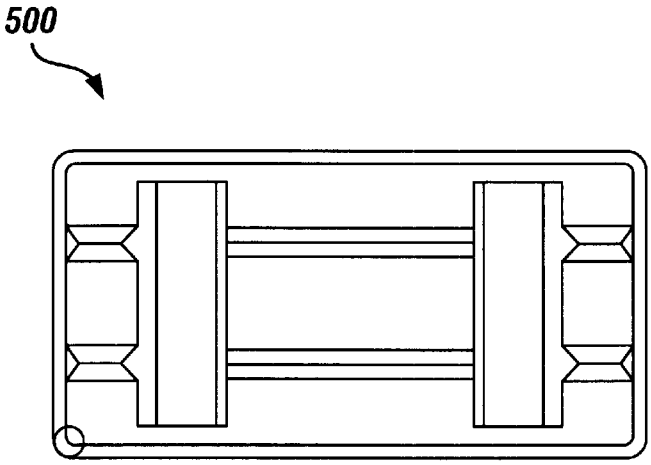
FIG. 5G is a schematic diagram of a bottom view of the compression plate shown in FIG. 5A.

In addition, lace lock 400 and the lacrosse head that receives it can be of complementary shapes or configurations such that, for example, lace lock 400 snaps into place, attaches by an interference fit, or attaches by some combination thereof FIGS. 4I–4L illustrate this type of interference fit. FIG. 4I illustrates lace lock 400 attached to lacrosse head 410 using an interference fit. The views of cross-sections A—A, B—B, and C—C of FIG. 4I are provided by FIGS. 4J, 4K, and 4L, respectively. FIG. 4J shows lace lock 400 attached to lacrosse head 410 using an interference fit. A screw hole 412 can receive a screw to further secure lace lock 400 to lacrosse head 410. FIG. 4J also shows a compression plate 414 (described in more detail below) on lace lock 400 for securing thongs. FIG. 4K illustrates how lacrosse head 410, lace lock 400, and compression plate 412 fit together from the perspective of cross-section B—B (of FIG. 4I). FIG. 4L illustrates how lacrosse head 410 and lace lock 400 fit together from the perspective of cross-section C—C (of FIG. 4I). As best shown in FIG. 4L, the shape of lace lock 410 fits in the recesses of lacrosse head 410 to provide a tight interference fit.

For both of the lace lock embodiments illustrated in FIGS. 2A–2I and FIGS. 4A–4L, the compression strap that envelops the area of the ridges 206 may further include a compression plate 500, which is illustrated in FIGS. 5A–5G. Compression plate 500 includes slots 502 through which to thread the compression strap, and bearing surfaces 504 which concentrate the force of the fastened compression strap onto the thongs. The size and shape of compression plate 500 conforms generally to the size and shape of the interior portion of lace lock 200 and 400 over ridges 206. Preferably, the shape is rectangular as viewed from a plan view (FIG. 5C) and is curved as viewed from a side view (FIG. 5E) to match the shape of a stick handle. In addition, bearing surfaces 504 and compression plate 500 are preferably made of the same hard material, e.g., ST-801 nylon by DuPont™. Alternatively, bearing surfaces 504 are made of a hard material, while compression plate 500 is preferably made of a slightly flexible material that conforms to the shape of ridges 206 and accommodates undulations typical of leather or synthetic thongs. With the compression strap thread through slots 502 and drawn tightly around the stick, compression plate 500 centers over the ridges and distributes a concentrated locking force to the thongs. Although bearing surfaces 504 are illustrated as linear structures, one of ordinary skill in the art would appreciate that other structures that provide a concentrated or point loading are equally suitable, such as pointed knobs.

The materials forming the components of the present invention preferably have durable physical properties such as toughness, impact resistance, limited flexibility, and shatterproof qualities. The preferred material is a moldable thermoplastic or thermosetting elastomer, examples of which include the nylon and urethanes well known in the art, which are typically made from reactants that are normally blended in the liquid state and cast into suitable molds to produce the lacrosse stick components. For example, lace locks 200 and 400, and the lacrosse stick head containing thong holes 300 may be formed by injection molding of one or more synthetic polymeric materials. Preferred materials for the head and lace lock are ST-801 nylon by DuPont™ and Delron™. The lacrosse stick head could also be made of a polycarbonate such as Lexan™.

Figure 6A:
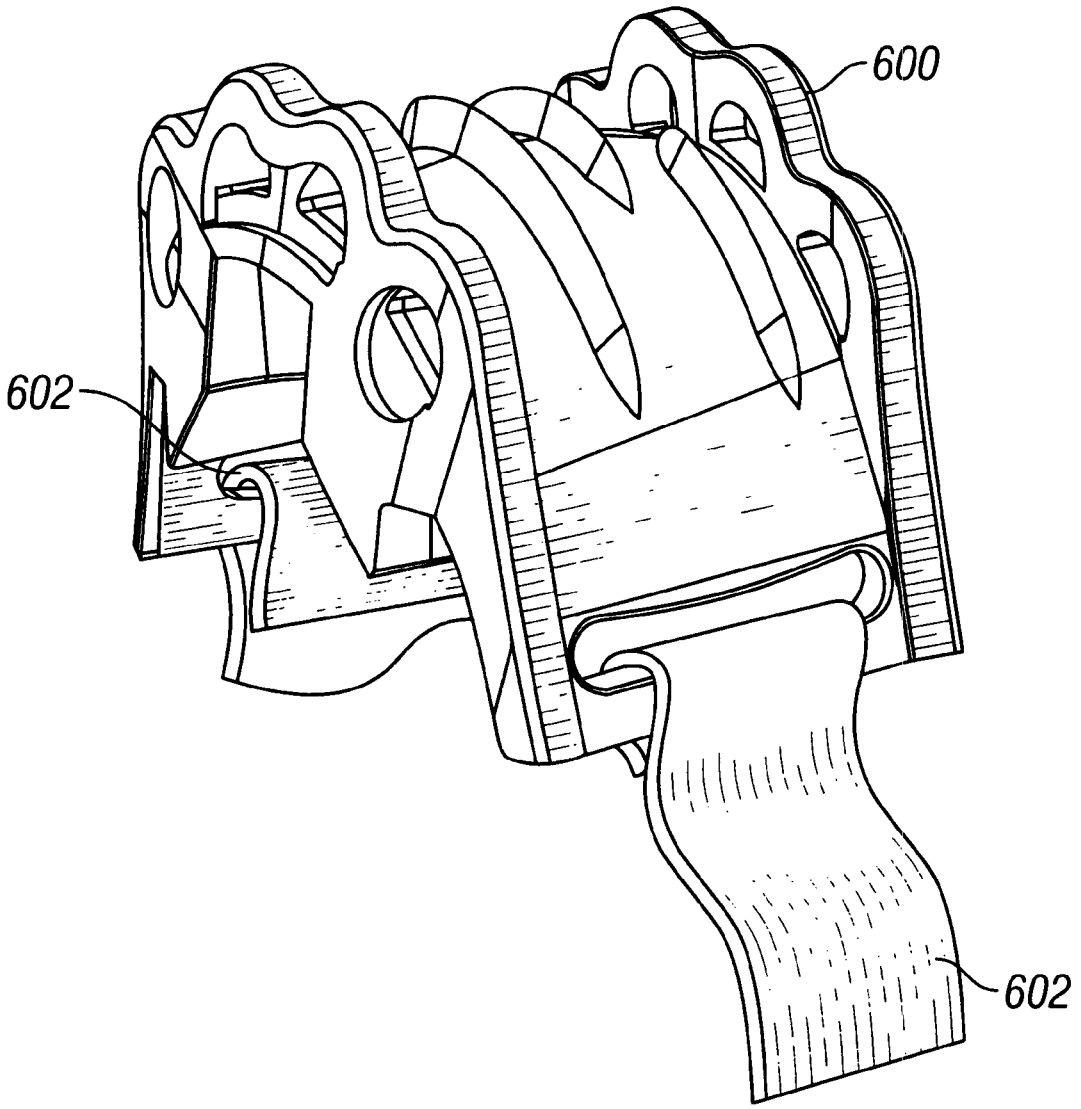
FIGS. 6A–6E are schematic diagrams depicting a preferred embodiment of the method for using the present invention.
Figure 6B:
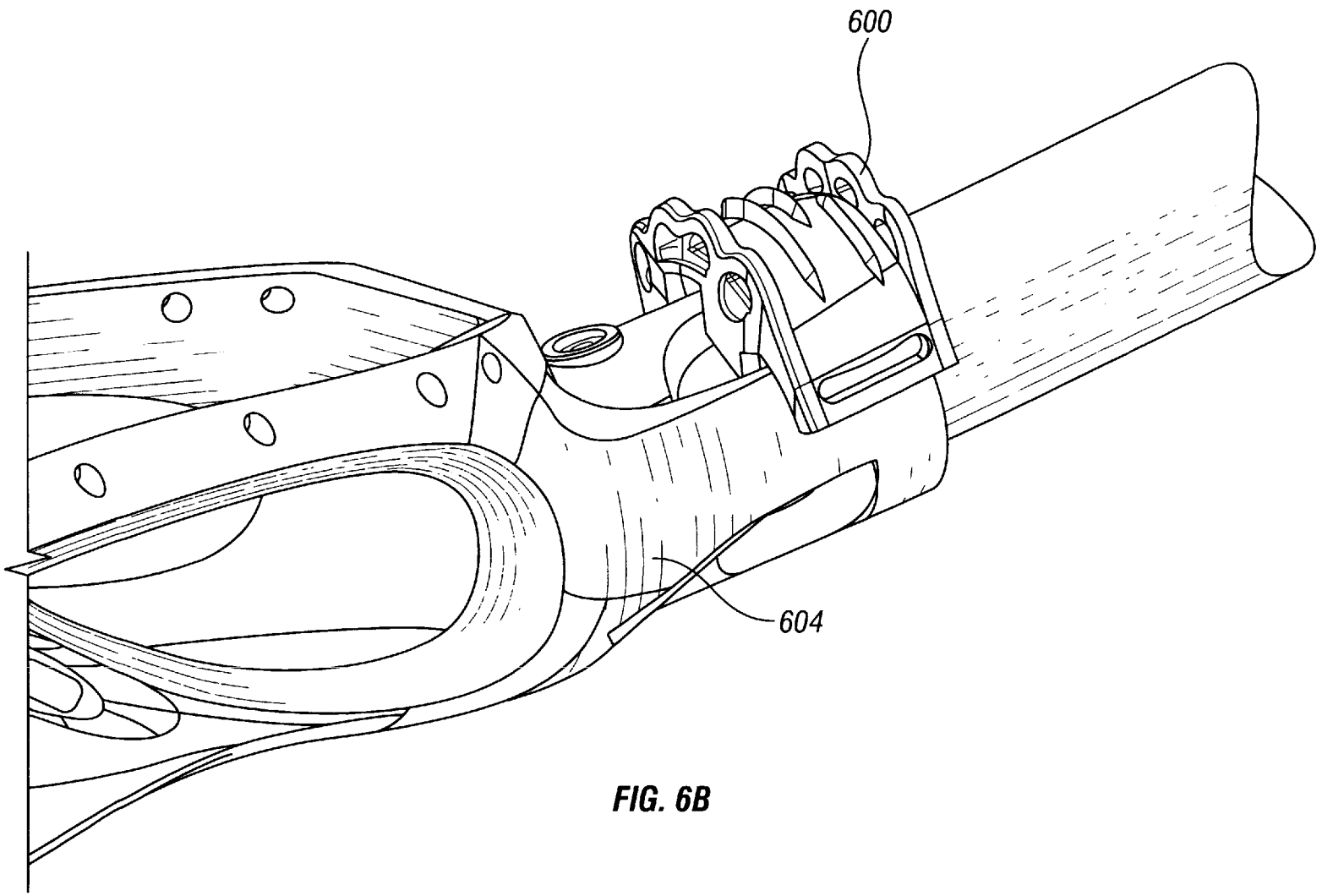

In providing secured and conveniently adjustable thong tension as well as more accurate ball control, the lace system of the present invention operates in the following manner, as illustrated in FIGS. 6A–6G. Although FIGS. 6A–6G illustrate the use of a lace lock with two sets of channeling holes, the method of operation applies equally to a lace lock with thong channels and a single set of exiting channeling holes. As shown in FIG. 6A, in a preferred embodiment of the present invention, a lacrosse player first removably attaches lace lock 600 to a lacrosse stick below the stop using a securing means, which in the case of FIG. 6A is a hook and loop fastener 602. Optionally, the player could elect not to attach lace lock 600 to the stick at this point, and instead simply rest lace lock 600 on the stick and secure lace lock 600 to the stick later with the compression strap (which also secures the thongs). As another option, as shown in FIG. 6B, the player could temporarily attach lace lock 600 using an interference fit provided by matching configurations of lacrosse head 604 and lace lock 600.

Figure 6C:
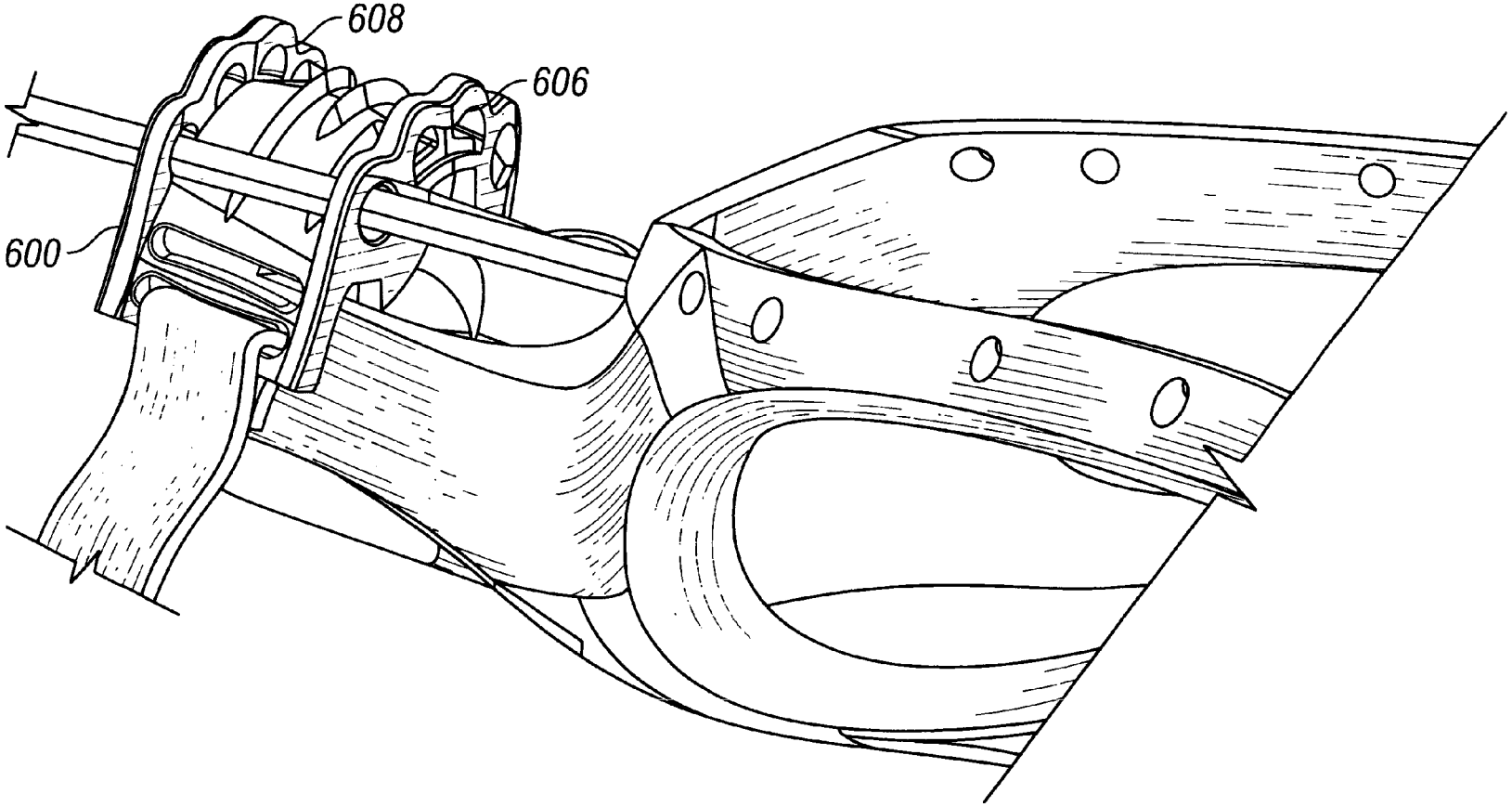
Figure 6D:
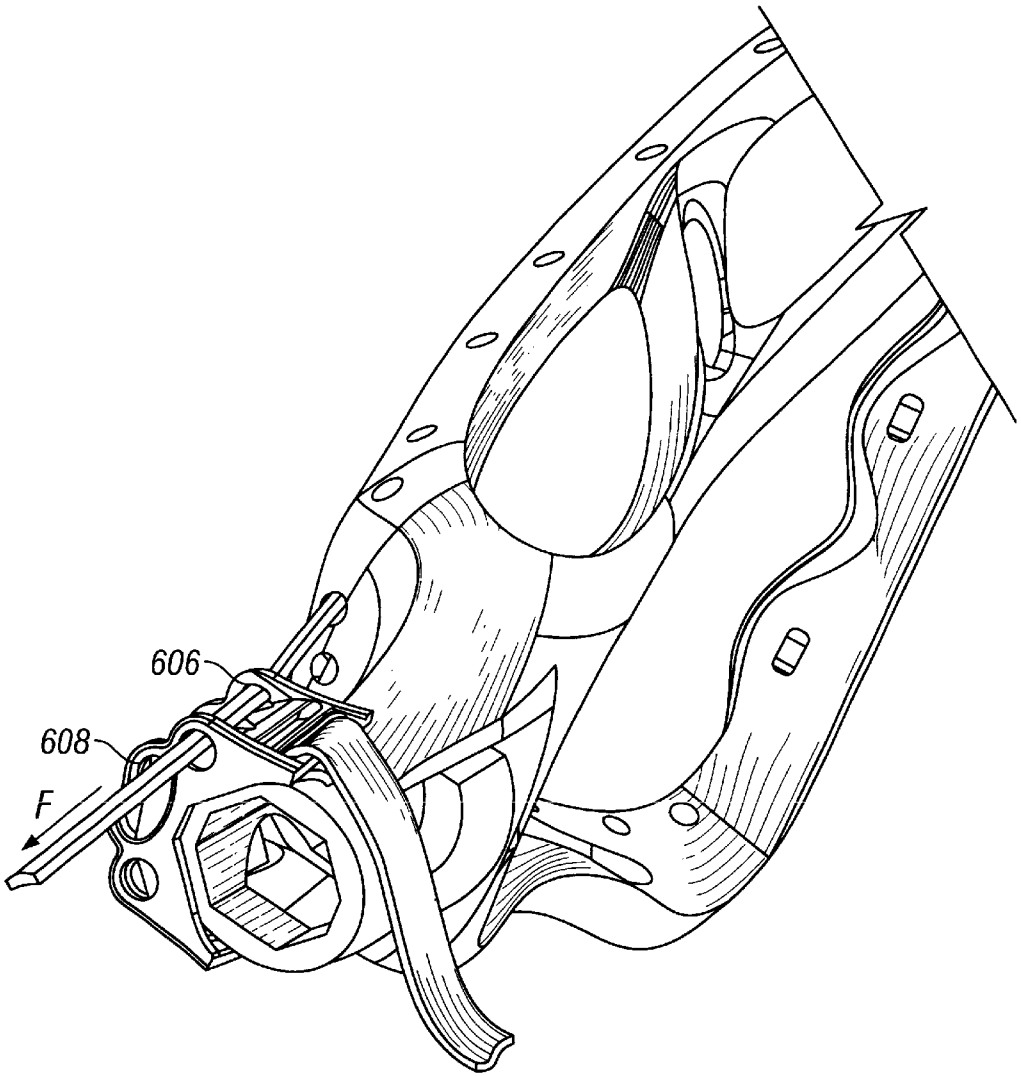

As shown in FIG. 6C, with lace lock 600 fastened to (or resting on) the stick, a player threads the thongs through incoming channeling holes 606 and exiting channeling holes 608. Because of the special shape of incoming channeling holes 606 and exiting channeling holes 608, the thongs span lace lock 600 with their wide, flat sides parallel to the face of the ridges of lace lock 600 and perpendicular to the ridges. Then, as represented by force F in FIG. 6D, the player pulls on the thongs to achieve the desired pocket tension and depth. (FIG. 6D shows only one thong for clarity.) Because the incoming channeling holes 606, the exiting channeling holes 608, and thong holes in the stop member of the lacrosse head are sized slightly smaller than the cross-section of a thong, the thongs are gripped to maintain a certain degree of tension.

Figure 6E:
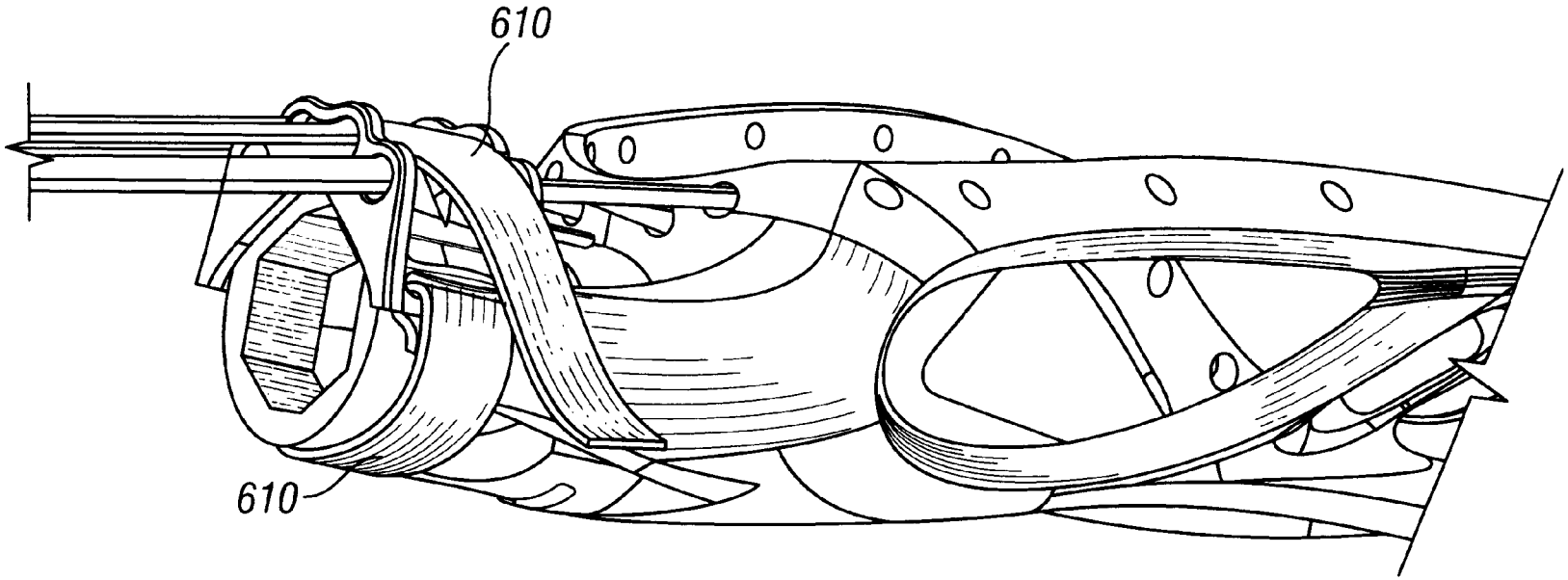

With the thongs under the desired amount of tension, as shown in FIG. 6E, the player then fastens compression strap 610 around the lacrosse stick and around lace lock 600, drawing tightly down on the thongs. Optionally, compression strap 610 could be fastened over the top of lace lock 600 only with a second strap fastened around the lacrosse stick.

In either case, under this compression, the thongs lock securely against the ridges and resist sliding. In addition, having the center thongs under tension in the specially positioned thong holes in the stop member of the lacrosse head creates a center channel that improves ball control.

A lacrosse player may repeat the steps illustrated in FIGS. 6A–6E as many times as desired. In this manner, the present invention provides a means to quickly and conveniently adjust thong and pocket tension just before and during play, and especially after an umpire discovers an illegal pocket that must be corrected before it is returned to play. Moreover, once a player achieves the desired pocket tension, the present invention positively locks the thongs in place, prevents the thongs from sliding, and eliminates the need for constant re-tying and re-taping. The unique combination of holes and channels of the present invention also serves to lock the thongs against sliding and to orient the thongs in a configuration that maximizes ball control.

Figure 7A:
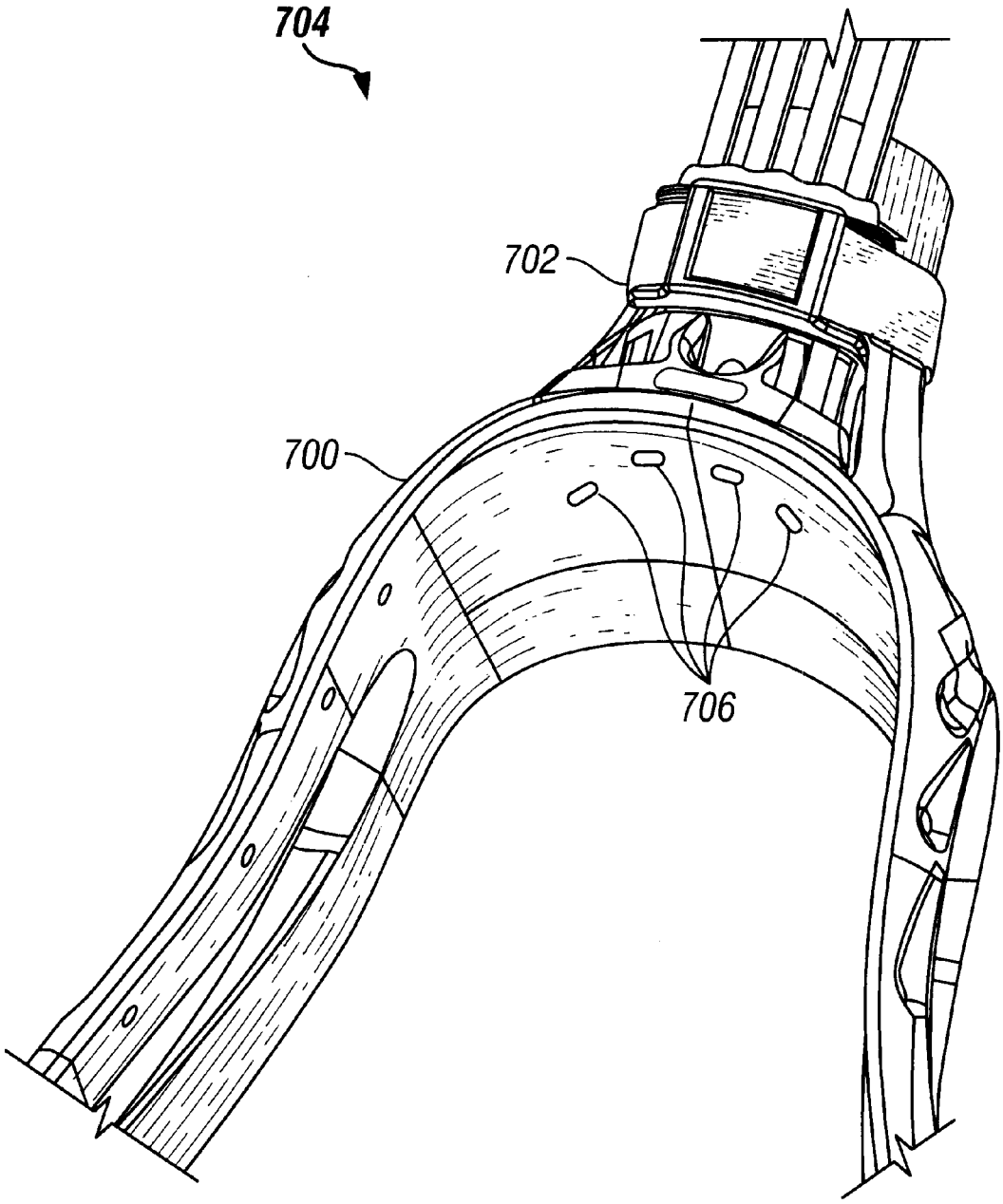
FIGS. 7A and 7B are isometric diagrams of a lace lock and lacrosse head assembled together, according to a preferred embodiment of the present invention.
Figure 7B:
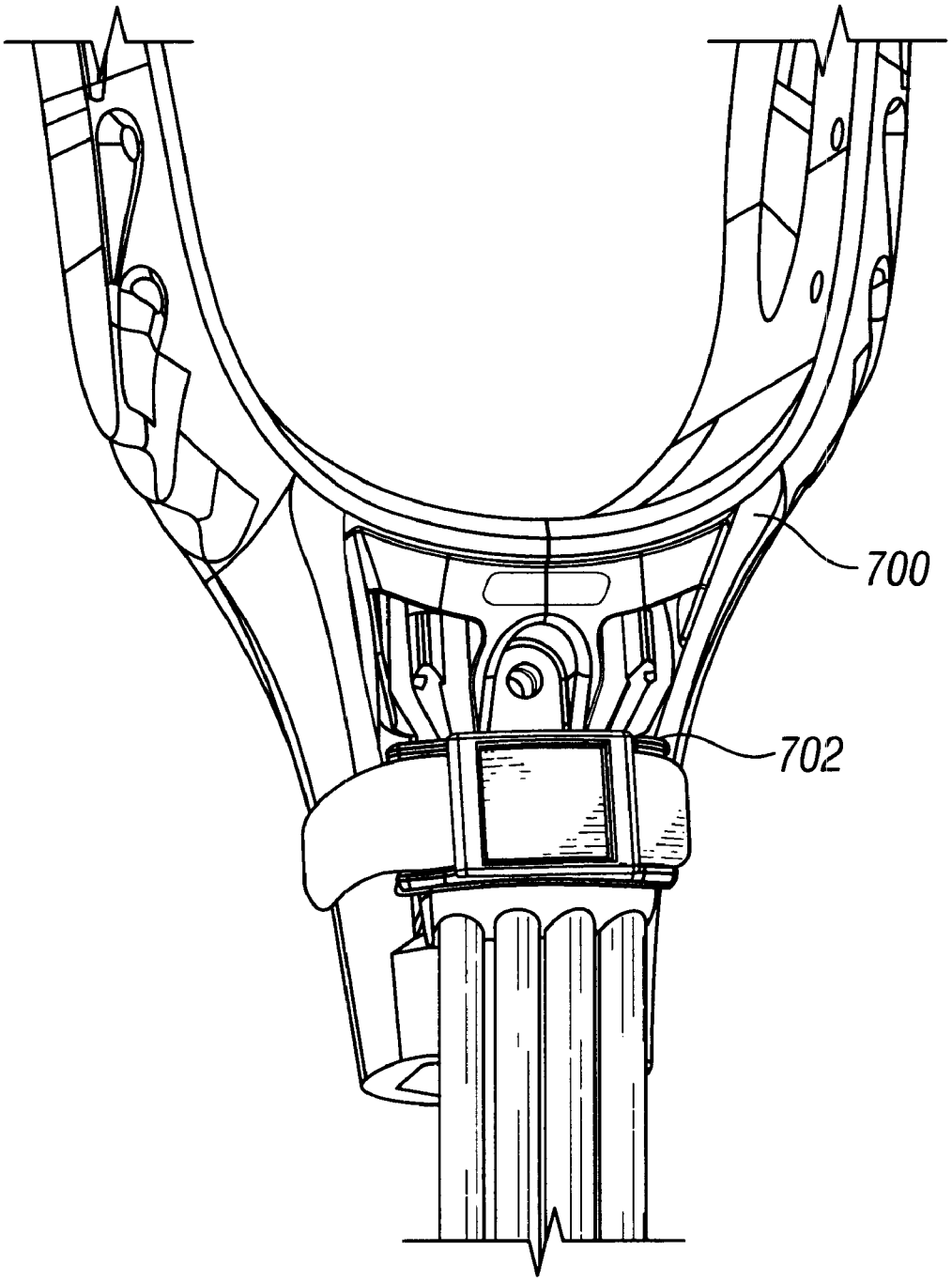

FIGS. 7A and 7B illustrate an assembly 704 of the matching components of a lacrosse head 700 and lace lock 702. These matching components fit integrally together to provide the locking mechanism of the present invention. As described above in reference to FIGS. 4I–4L, the designs of lacrosse head 700 and lace lock 702 use complementary shapes to provide an integral interference fit.

In an alternate representative embodiment of the present invention, assembly 704 of FIG. 7A could be a unitary structure. Thus, instead of assembling separate components, lacrosse head 700 and lace lock 702 are formed as a single piece, e.g., as a molded lacrosse head. In this way, thong holes 706 and the channels of lace lock 702 are unitary and continuous. In this embodiment, assembly 704 would provide the same structures and functions as the separate components described above (e.g., the lacrosse head and lace lock), but would do so as a unitary structure.

In describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, unless that order is explicitly described as required by the description of the process in the specification. Otherwise, one skilled in the art can readily appreciate that the sequences may be varied and still remain within the spirit and scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the claims.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A head for a lacrosse stick, the head having a generally V-shaped frame and comprising:

(a) a core area adapted to join a lacrosse handle;

(b) sidewalls extending from the core area to form the V-shaped frame;

(c) a scoop joining the sidewalls at their ends opposite to the core area, wherein the scoop has scoop thong holes adapted to receive thongs;

(d) a stop member joining the sidewalls at their ends opposite to the scoop, wherein the stop member has at least two outer thong holes and at least one inner thong hole, wherein the at least two outer thong holes are positioned higher on the stop member than the at least one inner thong hole, and wherein the at least two outer thong holes and the at least one inner thong hole are adapted to receive thongs; and (e) a lace lock adapted to receive the thongs and to tension the thongs between the scoop and the lace lock, wherein the lace lock has a channeling hole for each thong to keep the thongs spaced apart, and wherein the lace lock includes a strap that engages a plurality of the thongs between the stop member and the channeling holes.

2. A head for a lacrosse stick, the head having a generally V-shaped frame and comprising;

(a) a core area adapted to join a lacrosse handle;

(b) sidewalls extending from the core area to form the V-shaped frame;

(c) a scoop joining the sidewalls at their ends opposite to the core area, wherein the scoop has scoop thong holes adapted to receive thongs;

(d) a stop member joining the sidewalls at their ends opposite to the scoop, wherein the stop member has stop member thong holes adapted to receive the thongs from the scoop; and (e) a lace lock adapted to receive the thongs from the stop member and to maintain tension on the thongs between the scoop and the lace lock, wherein the lace lock has a channeling hole for each thong to keep the thongs spaced apart, and wherein the lace lock includes a strap that engages a plurality of the thongs between the stop member and the channeling holes.

3. The head of claim 2, wherein the lace lock is adapted to secure to the head below the stop member.

4. The head of claim 2, wherein the lace lock is adapted to secure to a lacrosse handle joining the core area.

5. The head of claim 4, wherein the lace lock is adapted to secure to the lacrosse handle below the core area of the head.

6. The head of claim 2, wherein the lace lock comprises:

(i) ridges adapted to grip the thongs; and (ii) a means for attaching the lace lock to the head, wherein the strap locks the plurality of the thongs against the ridges.

7. The head of claim 6, wherein the channeling holes are adapted to align and compress the thongs.

8. The head of claim 6, wherein the means for attaching the lace lock is selected from the group consisting of a screw through the lace lock and into a lacrosse handle joining the core area, a screw through the lace lock and into the head, a screw through the lace lock and into the head and the lacrosse handle, a hook and loop fastener, and an interference fit provided by matching configurations of the lace lock and the head.

9. The head of claim 2, wherein the head is a unitary structure such that the core area, the sidewalls, the scoop, the stop member, and the lace lock are a single piece.

10. The head of claim 2, wherein the stop member thong holes comprise at least one inner thong hole and at least two outer thong holes, and wherein the at least one inner thong hole and the at least two outer thong holes are configured such that thongs strung from the scoop to the stop member form a channel between the at least two outer thong holes.

11. The head of claim 2, wherein the stop member thong holes are adapted to compress the thongs.

12. A lacrosse stick comprising:

(a) a handle;

(b) a generally V-shaped lacrosse head, the head having a core area secured to the handle, sidewalls extending from the core area, a scoop joining the sidewalls at their ends opposite the core area, and a stop member joining the sidewalls at their ends opposite the scoop; and (c) a lace lock attached to the lacrosse stick on a side of the stop member opposite the scoop, wherein the lace lock is adapted to receive thongs, wherein the lace lock has a channeling hole for each thong to keep the thongs spaced apart, and wherein the lace lock includes a strap that engages a plurality of the thongs between the stop member and the channeling holes.

13. The head of claim 12, wherein the lace lock is attached to at least one of the handle and the core area of the head.

14. The head of claim 12, wherein the lace lock comprises:

(i) ridges adapted to grip the thongs; and (ii) a means for attaching the lace lock to the lacrosse stick, wherein the strap locks the plurality of the thongs against the ridges.

15. The head of claim 14, wherein the channeling holes are adapted to align and compress the thongs.

16. The head of claim 14, wherein the means for attaching the lace lock is selected from the group consisting of a screw through the lace lock and into the handle, a screw through the lace lock and into the head, a screw through the lace lock and into the head and the lacrosse handle, a hook and loop fastener, and an interference fit provided by matching configurations of the lace lock and the head.

17. The head of claim 12, wherein the head is a unitary structure such that the core area, the sidewalls, the scoop, the stop member, and the lace lock are a single piece.

18. The head of claim 12, wherein the stop member contains at least one inner thong hole and at least two outer thong holes, and wherein the at least one inner thong hole and the at least two outer thong holes are configured such that thongs strung from the scoop to the stop member form a channel between the at least two outer thong holes.

19. The head of claim 18, wherein the at least one inner thong hole and the at least two outer thong holes are adapted to compress the thongs.

20. The head of claim 2, wherein the lace lock has a second channeling hole for each thong to keep the thongs spaced apart, and wherein the second channeling holes are located between the stop member and the strap.

21. The head of claim 2, wherein the lace lock has incoming channels adapted to receive the thongs from the stop member and to rotate the thongs from horizontal to vertical, and wherein the channeling holes are adapted to rotate the thongs from vertical to horizontal as the thongs exit the incoming channels.

22. The head of claim 2, wherein the lace lock has a compression plate attached to the strap, the compression plate including one or more slots that receive the strap and a bearing surface adapted to compress the thongs.

* * * * *